United States Patent [19]

Decker, II

[11] 4,003,308

[45] Jan. 18, 1977

[54] INK ROLL POSITIONING APPARATUS FOR PRESS

[75] Inventor: Charles E. Decker, II, Canton, Ohio

[73] Assignee: The Dillon Electric & Machine Co., Canton, Ohio

[22] Filed: May 7, 1975

[21] Appl. No.: 575,410

[52] U.S. Cl. ..... 101/351; 101/329; 101/218; 101/352

[51] Int. Cl.[2] ..... B41F 31/30

[58] Field of Search ..... 101/351, 352, 357, 358, 101/361, 362, 348, 349, 218, 247, 184, 185

[56] References Cited

UNITED STATES PATENTS

| | | | |
|---|---|---|---|
| 2,778,303 | 1/1957 | Stempel | 101/218 |
| 2,874,636 | 2/1959 | Koyer et al. | 101/218 |
| 3,128,207 | 4/1964 | Schmitt | 101/169 X |
| 3,259,060 | 7/1966 | Martin | 101/348 X |
| 3,366,047 | 1/1968 | Hermach et al. | 101/348 X |
| 3,404,626 | 10/1968 | White et al. | 101/352 X |
| 3,491,686 | 1/1970 | Zurick | 101/352 |
| 3,595,164 | 7/1971 | Hovekamp | 101/351 X |
| 3,732,814 | 5/1973 | Pasquinelli | 101/218 |
| 3,817,174 | 6/1974 | Pavlson | 101/218 |

*Primary Examiner*—Edward M. Coven
*Attorney, Agent, or Firm*—Oldham & Oldham Co.

[57] ABSTRACT

The printing press includes a printing cylinder and an inking roll operatively positioned on a frame means and characterized by positioning arms engaging the inking roll for pivotal movement of such roll towards and away from the printing cylinder to operative and inoperative positions, respectively. Fluid actuating means operatively engages the positioning arms for moving the inking roll and an adjustment device is present to control the extent of movement of said inking roll. Further adjustment means are provided in the positioning arm engaging one end of the inking roll to aid in operatively positioning the inking roll parallel to the printing cylinder.

5 Claims, 4 Drawing Figures

INK ROLL POSITIONING APPARATUS FOR PRESS

BACKGROUND OF INVENTION

Heretofore there have been many different kinds of printing presses provided and the present invention particularly is described in relation to a two revolution hand feed sheet fed gravure press for multi-color printing from flat copper plates.

Printing presses very similar to that of the present invention were made in the early 1900's by Linotype & Machinery, Ltd., and such prior types of printing presses were fully mechanically controlled and operated. Frank Hyman may have had one or more patents on the press. These prior printing presses of the same type as those of the present invention involved relatively heavy moving parts, substantially all of the control functions thereof were driven or obtained from the operative drive of the machine and the press, as a whole, was difficult to operate and not convenient to use or to control. The inking roll in the prior presses was moved to inoperative position by two manually moved lever arms accessible only when a feed portion of the press was swung to inoperative position.

The general object of the present invention is to provide a new and improved printing press, and especially to provide a fluid actuated means for control of the position of the inking roll provided in the press.

Another object of the invention is to provide a pneumatically operated piston and cylinder for controlling the position of the inking roll in the press independent of the drive of the press, and to permit adjustment in the positioning of the inking roll and the stroke or length of movement of the same.

Yet another object of the invention is to provide a special adjustment device in a positioning arm engaging one end of the inking roll to facilitate independent movement of one end of the printing roll to enable such roll to be positioned on an axis parallel to that of the printing cylinder.

Yet another object of the invention is to provide lightweight, improved, rapidly functioning, easily maintained means for positioning an inking roll in a printing press and to move the inking roll out of the inking tank or pan.

The foregoing and other objects and advantages of the present invention will be made more apparent as the specification proceeds.

In the accompanying drawings.

When referring to corresponding members shown in the drawings and referred to in the specification, corresponding numerals are used to facilitate comparison therebetween.

SUBJECT MATTER OF INVENTION

Figure 1:
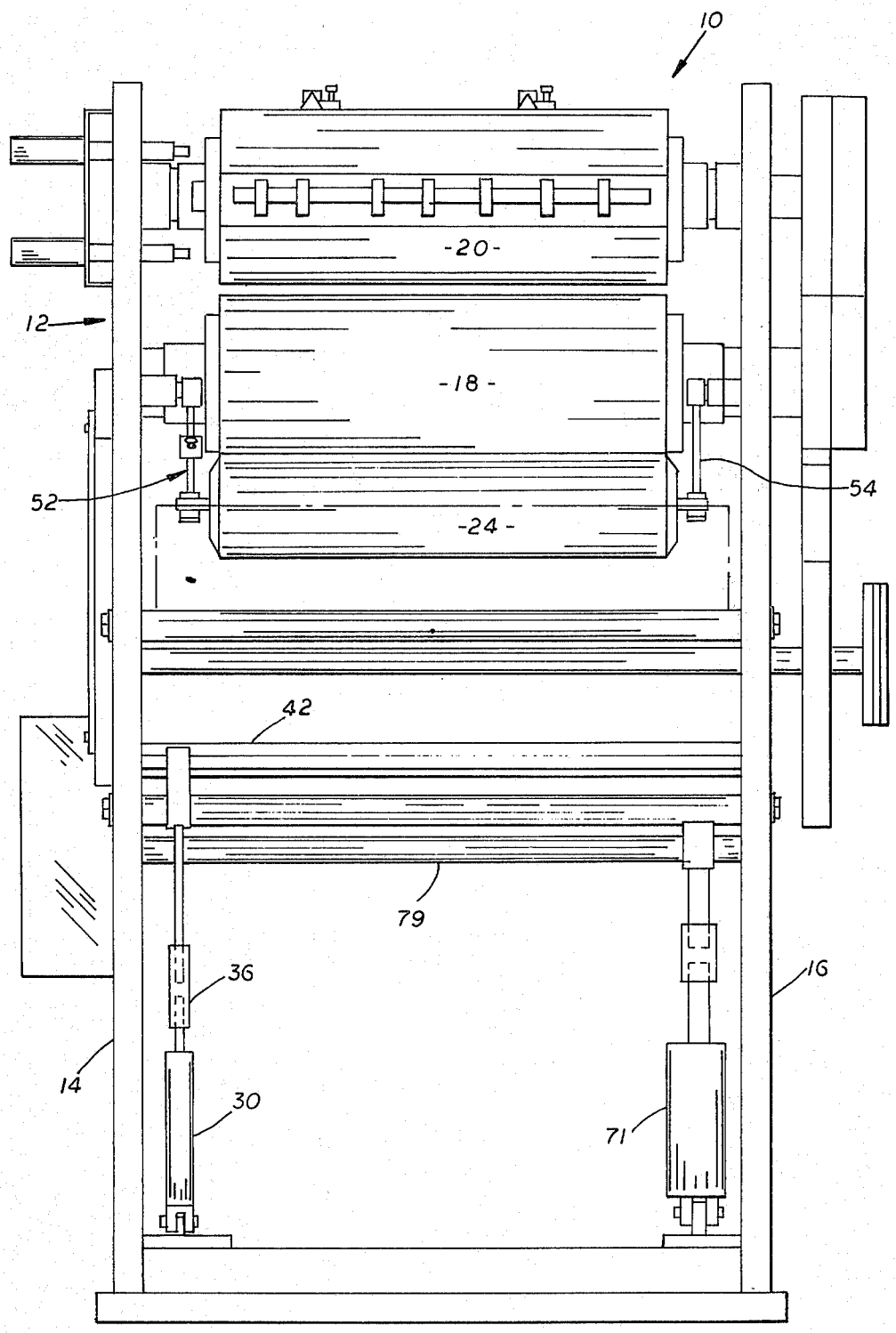
FIG. 1 is a front elevation of the printing press of the invention.

In a printing press, a frame means including a pair of opposed side plates, a printing cylinder journalled on and extending between the side plates, an inking roll and an inking tank, and characterized by a positioning arm adjacent each side of the frame and engaging the ends of the inking roll for pivotal movement of the inking roll towards and away from the printing cylinder, and fluid-actuated means operatively engaging and controlling the positioning arms to move the inking roll to and from operative association with the printing cylinder and into and out of engagement with the inking tank, respectively, the fluid-actuating means including an adjustment device for aid in controlling the relationship of the inking roll to the printing cylinder and the operative positioning of the inking roll.

Reference now is particularly made to the accompanying drawings wherein the primary operative portions of the printing press 10 are shown. This press 10 includes a frame means 12, including a pair of opposed side plates 14 and 16, and a printing cylinder 18, the ends of which are operatively journalled on the frame means 12 to position it on the upper portion of the frame means 12 at one end of the printing press. Such cylinder is operatively associated with an impression cylinder 20 used to carry the paper sheets having printing operations performed thereon by the apparatus. Below the printing cylinder 18, an inking pan or tank 22 is positioned and ink is supplied thereto in suitable amounts by any conventional means for maintaining a desired pool of ink therein. An inking roller 24 normally is positioned in the inking pan 22 to have a portion of its periphery extend down into a quantity or pool 26 of ink received in the pan for receiving a layer of ink on the periphery of the inking roll for transmission to the cylinder 18 in a conventional manner.

Figure 2:
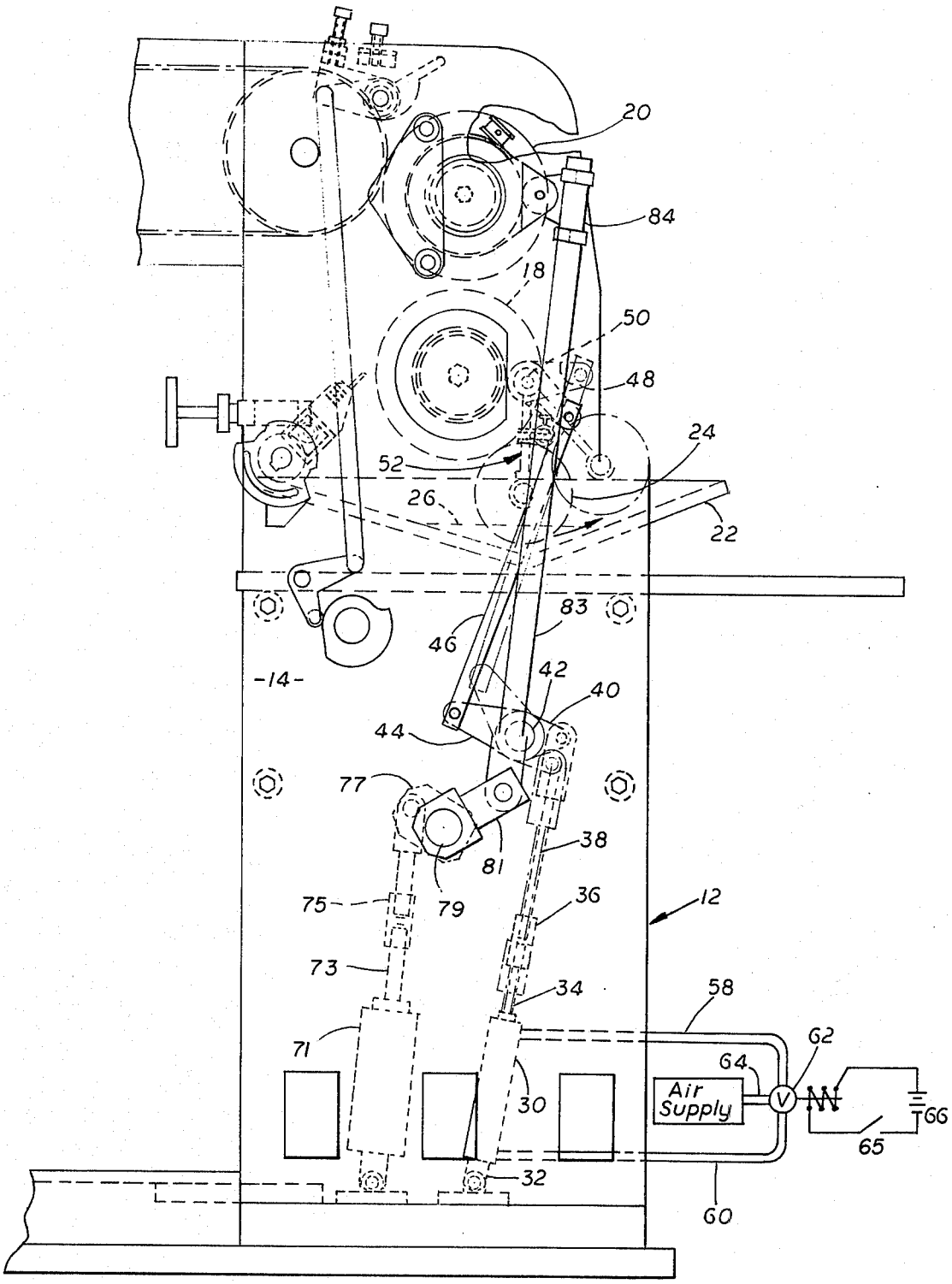
FIG. 2 is a side elevation of the press of FIG. 1.
Figure 3:
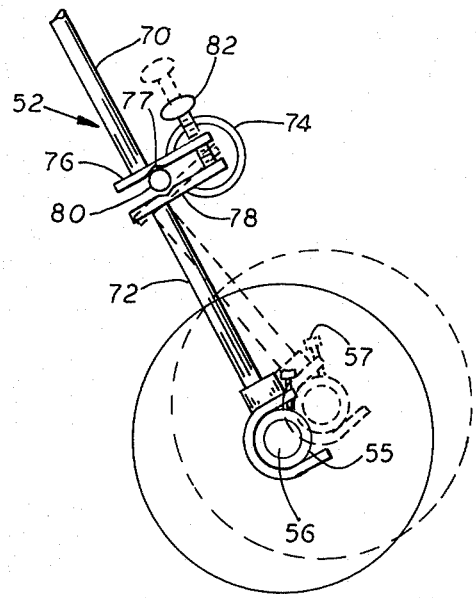
FIG. 3 is a fragmentary enlarged detail of one positioning arm for the printing roll of the press.
Figure 4:
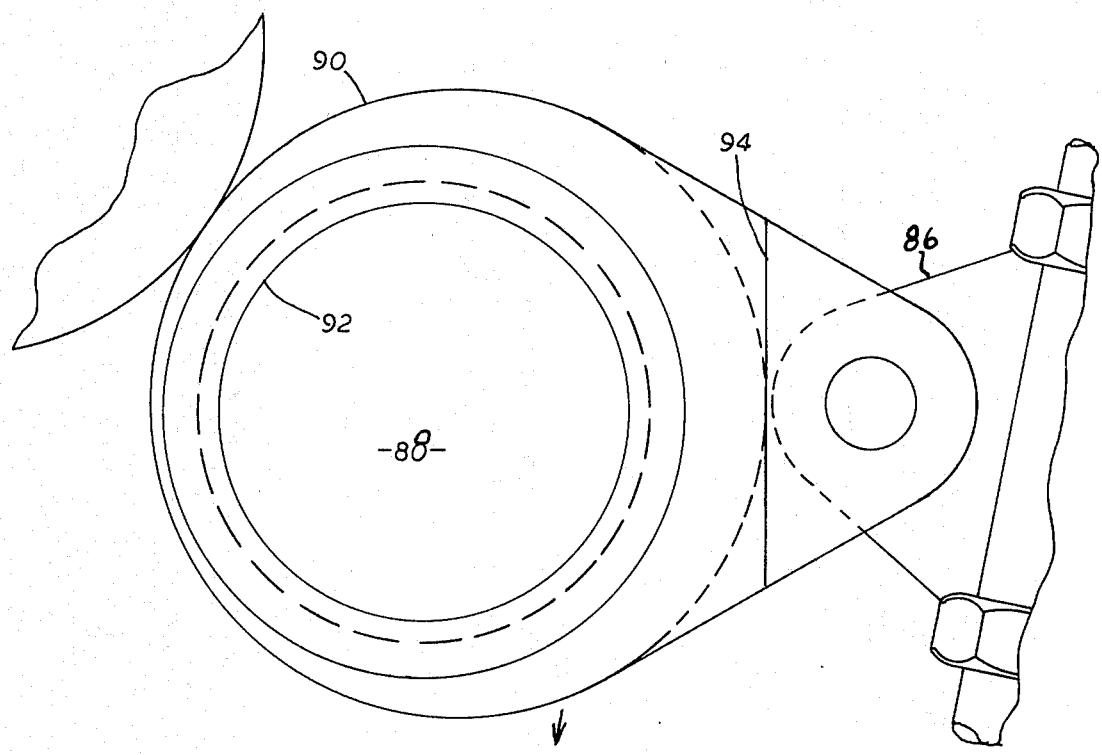
FIG. 4 is a fragmentary elevation of a portion of the impression cylinder control means.

As an important feature of the present invention, fluid-actuated means are provided for operatively engaging the inking roller 24 for controlling the position thereof and for moving it to and from operative association with the cylinder 18 and the ink pool 26 received in the inking pan. Thus, FIG. 2 of the drawings shows that an air-actuated cylinder 30 is pivotally supported at one end 32 on a base portion of the frame means 12 with the piston rod 34 from the air cylinder 30 extending up from the opposite end of the air cylinder engaging a turnbuckle 36. A connecting rod 38 extends from the opposite end of the turnbuckle 36 and is pivotally secured to an arm 40 that is secured to a transversely extending shaft 42 suitably journalled on and extending between the side plates 14 and 16. This shaft 42 has individual control levers 44 secured to each end thereof, and usually with such ends of the shaft 42 protruding laterally slightly from the side plates 14 and 16. A connecting link 46 is in pivotal engagement with each of the lever arms 44 and such links extend up to and engage an arm 48 secured to and extending radially from a stub shaft 50 one of which is journalled in each of the side plates 14 and 16. These stub shafts 50 extend through the side plates and are positioned above the inking roller 24 but with each shaft 50 secured to and controlling either a positioning arm 52 or 54 thereon. FIG. 2 of the drawings shows the positioning arm 52 on the lefthand frame portion or side plate 14 of the apparatus whereas the positioning arm 54 is carried on the shaft 50 on the side plate 16. These positioning arms extend downwardly of the apparatus and operatively engage and are secured to bushings 55 on support shafts 56 extending from opposite ends of the ink roll. Set screws 57 on U-shaped ends of the positioning arms engage the bushings 55 whereby the rotary inking roller 24 is suitably supported by and journalled on the positioning arms. The inking roll is in conventional geared engagement with the drive means (not shown) of the printing press.

The air cylinder 30 can be actuated independent of the press drive in any suitable manner and thus air supply tubes 58 and 60 are shown operatively connecting to opposite ends of this cylinder and with air supply to opposite ends of the cylinder being controlled by means such as a spring biased solenoid-actuated valve 62 having compressed air supplied thereto from any suitable source by line 64.

The air cylinder is controlled through the valve 62 by a control switch 65 connecting to any desired power supply 66 whereby the solenoid for the valve 62 can be actuated to supply pressure to the cylinder to move its piston from one extremity of its movement to the other for moving the inking roller from the operative association shown with the cylinder 18 to a position out of contact with such cylinder, as indicated in dotted lines in FIG. 2 of the drawings. Opening the switch 65 releases the valve to return it and the inking roller to their prior positions.

It will be realized that the turnbuckle 36 or other equivalent adjustment device of any known type can be used with the cylinder 30 or in the operative control system or means for the inking roller 24 to vary the extent of movement thereof in moving it to and from its operative position and to adjust its operative position.

As yet another important feature of the invention, the positioning arm 52 of the invention is provided with an adjustment therein for altering the position of one end of the inking roller 24. Thus such positioning arm 52 is formed from two sections 70 and 72 that are connected together by an arcuate spring clip 74 which engages end plates 76 and 78, respectively, suitably secured to the arm sections 70 and 72 and extending therefrom normal to the longitudinal axes thereof. A fulcrum roller or means 80 is positioned between these end plates 76 and 78 spaced from the longitudinal axes of the arm section by V-notches 77. The ends of the spring clip 74 urge the end plates 76 and 78 together at the outer ends thereof, and a control set screw 82 is in threaded engagement with the end plate 76 and bears on the end plate 78 whereby the end portions of these plates can be forced apart from each other, or can be permitted to move towards each other by the resilient action of the clip 74. Such action moves the arm sections 70 and 72 in a plane determined by these arm sections and end plates 76 and 78 which plane is normal to the axis of the plate cylinder. This movement permits a fine adjustment in the positioning of one end of the inking roll in relation to the plate or printing cylinder 18. FIG. 2 of the drawings shows that the arm 52 is centered on an axis parallel to the printing cylinder and between the vertical margins of such cylinder to provide accurate adjustment of position of one end of the inking roll. Hence, the initial setting of the inking roll can be determined by the turnbuckle 36 or equivalent means for the general position of the inking roll, but final adjustment, and parallelism between the inking roll and the printing cylinder is obtained by the fine adjustment provided by the set screw 82 and associated means. The arm 52 is rigid under the load applied.

Thus, at any desired time, regardless of whether or not the apparatus is operating, the switch 65 can be closed and the inking roll can be moved to inoperative position. Such action does not require any movement of the paper feed board assembly (not shown) usually present on the press. The invention also facilitates the changing of position of the inking roll with changes in viscosity of the inks used.

The invention also contemplates moving the impression cylinder 20 out of operative engagement with the printing cylinder 18 independent of the drive of the press 10. Thus an air cylinder 71 is pivotally mounted on the frame 12 and its piston rod 73 connects through a position adjusting turnbuckle 75 to a lever 77 on a cross shaft 79 journalled on and extending between the side plates 14 and 16. The shaft 79 has ends protruding from the frame side plates and a lever arm 81 is secured to each end on such shaft on the outside of the frame. Connecting links 83 extend upwardly of the frame on each side thereof and pivotally engage one of the lever arms 81. A connector block 84 is secured to each link 83 at the upper end thereof and it has a connector flange 86 extending therefrom. The impression cylinder has a shaft 88 the ends of which extend through apertures in the side plates and engage support eccentrics 90 at each end. Bushings 92 journal the shaft 88 in the eccentrics. These eccentrics 90 have annular peripheries journalled in the side plates but being provided with eccentric bores receiving the bushings 92 and shaft 88 therein. Such eccentrics each have a bifurcated flange plate 94 extending therefrom and straddling the connector flanges 86. Pins 96 pivotally connect the flange plates 94 to the connector flanges 86. Hence arcuate movement of the support eccentrics 90 will move the impression cylinder 20 to and from operative relation to the printing cylinder 18. Such movement is produced by actuation of the air cylinder 70 transmitted to the links 83 and connector blocks 84 to cause pivotal movement of the eccentrics 90 in the frame with resultant movement of the impression cylinder 20 in relation to the printing cylinder.

A suitable control means like the valve 62 and associated controls for the air cylinder 30 are provided for the air cylinder 70 to provide movement for the impression cylinder independent of the press drive.

The present invention provides a positive, easily operated means for controlling the position of the inking roll in a printing press. Thus it is believed that the objects of the invention have been achieved.

While one complete embodiment of the invention has been disclosed herein, it will be appreciated that modifications of this particular embodiment of the invention may be resorted to without departing from the scope of the invention.

What is claimed is:

1. In a printing press including a frame means comprising a pair of opposed side plates, a printing cylinder journalled on and extending between said side plates, and an inking roll adjacent said printing cylinder, and characterized by a positioning arm mounted on each side of said plates each engaging an end of said inking roll for pivotal movement thereof towards and away from said printing cylinder, one of said positioning arms having two axially spaced parts, fluid actuated means operatively engaging both of said positioning arms to move said inking roll to and from operative association with said printing cylinder, said fluid actuated means including connection means and a first adjustment means to control the position of said inking roll in relation to said printing cylinder; and said one of said positioning arms includes an arcuately movable second adjustment means connecting said arm parts to adjust the relative arcuate positions of said arm parts and of only one end of said inking roll to move it towards or away from said printing cylinder, said adjustment means being movable in a plane perpendicular to the axis of said printing cylinder.

2. In a printing press as in claim 1 where said second adjustment means includes individual end plates secured to adjacent ends of said arm parts and extending from the individual said arm parts perpendicular to the longitudinal axes thereof, a fulcrum means positioned between said end plates, and spring clip and set screw means operatively connecting said end plates and providing pivotal movement between said arm parts in one plane by adjustment of said set screw.

3. In a printing press including a frame means, a printing cylinder journalled on and extending between opposed portions of the frame means, an inking roll, and an ink pan positioned adjacent and below said inking roll to supply ink to said inking roll, and characterized by a pair of positioning arms engaging the ends of said inking roll for pivotal movement of said inking roll towards and away from said printing cylinder, control means operatively engaging both of said positioning arms to move said positioning arms through an arc to move said inking roll to and from operative association with said printing cylinder, said positioning arms engaging said inking roll at corresponding ends of said positioning arms to position said inking roll adjacent the periphery of said printing cylinder, only one of said positioning arms being made in two axially separated parts, and an arcuately adjustable device operatively connecting adjacent ends of the parts of said one positioning arm and providing movement therebetween in a plane formed by said arm parts which define a variable angle therebetween, the ends of said one positioning arm engaging, respectively, said frame means and said inking roll whereby the position of one end of said inking roll can be independently adjusted by said adjustable device.

4. In a printing press as in claim 3 where one of said arm parts is an end part that engages the end of said inking roll, and the arcuate movement of said end part is in a plane perpendicular to the axis of said printing cylinder, and said one positioning arm is positioned to move one end of said inking roll towards and away from the periphery of said printing cylinder.

5. In a printing press as in claim 4 where said adjustable device includes individual end plates secured to adjacent ends of said arm parts and extending from the individual said arm parts perpendicular to the longitudinal axes thereof, a fulcrum means positioned between said end plates, and each spring clip and set screw means operatively connecting said end plates and providing pivotal movement between said arm parts in one plane by adjustment of said set screw.

* * * * *